United States Patent [19]

Schwartz

[11] Patent Number: 4,711,191

[45] Date of Patent: Dec. 8, 1987

[54] MONOFILAMENT-WRAP TEXTURIZING METHOD AND PRODUCT

[75] Inventor: Nathan G. Schwartz, Bryn Mawr, Pa.

[73] Assignee: Techniservice, Kennet Square, Pa.

[21] Appl. No.: 926,800

[22] Filed: Nov. 4, 1986

[51] Int. Cl.[4] ..... D05C 17/02; D02G 1/12; D02G 3/24; D02G 3/36

[52] U.S. Cl. ..... 112/410; 28/265; 57/6; 57/227; 57/228; 57/351; 428/229

[58] Field of Search ..... 57/210, 227, 228, 229, 57/6, 350, 351; 428/222, 225–229; 28/263–269; 112/410, 411, 415, 416

[56] References Cited

U.S. PATENT DOCUMENTS

| | | | |
|---|---|---|---|
| 2,971,322 | 2/1961 | Bouvet | 57/228 |
| 3,217,482 | 11/1965 | Baer | 57/6 |
| 3,264,816 | 8/1966 | Jaggi | 57/228 X |
| 3,413,697 | 12/1968 | Agett et al. | 28/265 X |
| 3,438,193 | 4/1969 | Kosaka et al. | 57/351 X |
| 3,460,336 | 8/1969 | Collingwood et al. | 57/351 X |
| 3,675,409 | 7/1972 | Rosenstein | 57/229 |
| 3,769,787 | 11/1973 | Rosenstein | 57/228 X |
| 3,950,932 | 4/1976 | Durling | 57/351 X |
| 4,346,553 | 8/1982 | Schwartz | 57/210 |

FOREIGN PATENT DOCUMENTS

| | | | |
|---|---|---|---|
| 52-21442 | 2/1977 | Japan | 57/351 |

*Primary Examiner*—John Petrakes

*Attorney, Agent, or Firm*—Austin R. Miller

[57] ABSTRACT

A plurality of heavy denier thermoplastic monofilaments is gathered together and continuously wrapped with a flexible wrapper yarn. The wrapped bundle is fed into a stuffer crimper to form a multiplicity of texturized bends. The product is a stiff, pliable texturized yarn and the nomofilaments in the wrapped bundle have a multiplicity of heat-set bends repeating lengthwise along the lengths of the monofilaments.

8 Claims, 3 Drawing Figures

MONOFILAMENT-WRAP TEXTURIZING METHOD AND PRODUCT

This invention relates to a stiff, pliable yarn product, particularly a product in stiff bundle form useful as bristles, brushes, floor coverings and the like.

This invention is particularly directed to a stiff yarn product having high efficiency and long life when used as face fibers in floor coverings, such as tufted and woven carpet, mats and rugs.

Still further, this invention relates to a carpet or mat comprising a base and a multiplicity of tufts extending from the base, wherein the tufts comprise a stiff, pliable springlike yarn product in accordance with this invention.

This invention further relates to a monofilament wrap texturizing method for making such a stiff, pliable yarn product with efficiency and economy.

DISCUSSION OF THE PRIOR ART

Helically wrapped yarns are well known per se. The patent to Rosenstein et al U.S. Pat. No. 3,769,787 discloses a yarn comprising a core having a plurality of synthetic filaments, maintained coherent and compact for high speed fabricating purposes, by continuously disposing special wrapper filaments in generally helical paths around the core filaments of the yarn, at least one such wrapper filament being disposed in a clockwise manner and another wrapper filament counterclockwise. In the method utilized by the patent to Rosenstein et al, the wrapper filaments are continuously applied from over the ends of supply packages, and are continuously wrapped around the core. The core filaments, as stated, are synthetic filaments, and the wrapper filaments are applied to the core under low tension. In accordance with the disclosure of Rosenstein et al, the filaments may be either drawn or undrawn, and the helically wrapped product may be drawn subsequent to formation.

Another patent to Rosenstein U.S. Pat. No. 3,675,409 discloses a multifilament tow which is rendered compact by continuously disposing wrapper yarns in generally helical paths around the tow, one clockwise and the other counterclockwise. Again, the purpose of the helical wrapping is to render the filaments of the tow compact, so that they can be readily handled in subsequent packaging operations.

The patent to Schwartz U.S. Pat. No. 4,346,553 discloses a core yarn having a plurality of wrapper yarns wrapped under tension in both the clockwise and counterclockwise directions. The core is composed of low-denier staple fibers having substantially no twist, and the tensions on the wrapper yarns are balanced by each other and are so high as to compress the core and impart to the core a sinuous configuration along its length.

OBJECTS OF THIS INVENTION

In sharp contrast to the disclosures of the prior art, it is an object of the present invention to provide a stiff, pliable yarn product highly useful for its stiffness and long wear, and particularly suited to use as bristles in doormats, floor mats, carpets and the like, especially those exposed to severe conditions of wear, and to hostile environments.

Other objects and advantages of this invention, including the simplicity, economy and high productivity with which the product may be made, and the ease with which the yarn product may be incorporated into fabrics of various types, will further become apparent hereinafter, and in the drawings.

DRAWINGS

Figure 1:
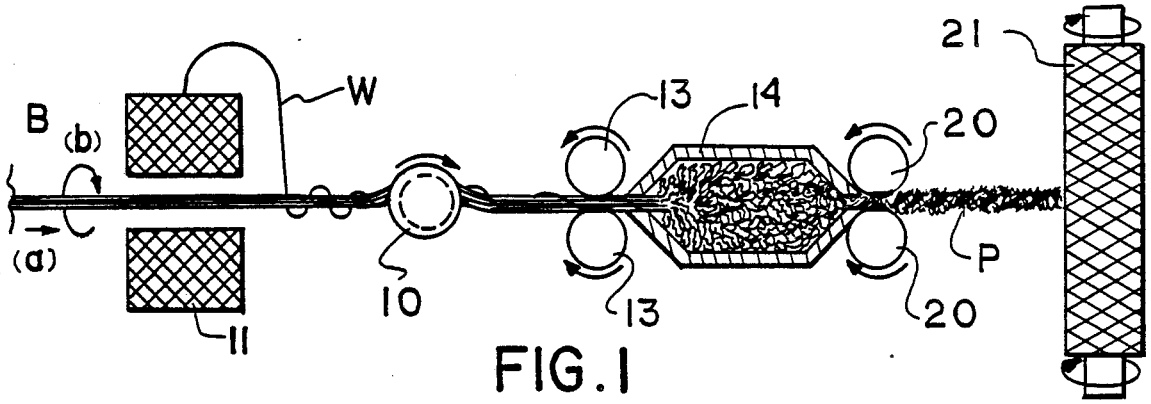
FIG. 1 is a schematic view in side elevation, with certain parts broken away and shown in section in order to reveal important details, showing one embodiment of apparatus and method for producing a novel yarn in accordance with this invention.

Turning now to the specific forms of the invention selected for illustration in the drawings, which are intended for illustrative purposes and not as limiting the scope of the appended claims, FIG. 1 shows a bundle B of individual monofilament yarns drawn from wound supply tubes of packaged monofilaments in the direction of the arrow (a). Although the bundle B contains at least about 5 to 30 monofilaments, or more, these are not individually shown in FIG. 1, for the sake of simplicity and easy understanding. The number 11 designates a package of wrapper yarn W, mounted for rotation in the direction of the arrow (b) in FIG. 1. Bundle B is caused to advance continuously through the center opening of package 11, whereupon rotation of package 11 wraps the yarn W in a helical configuration 12 about the bundle B. The wrapped yarn is conducted around a heated godet 10. The numbers 13, 13 designate feed rolls associated with the entrance of the stuffer box crimper 14, whereupon the helically wrapped heated bundle B is forced under pressure into the stuffer box 14. Continuous feed of bundle B against the resistance of previously fed material contained within the chamber of stuffer box crimper 14 causes the bundle, which is at an elevated temperature, repeatedly while controlled by the wrapper yarn, to buckle and fold upon itself as a unit, to form a multiplicity of zigzag crimps. Material contained within the chamber of stuffer box 14 is pulled out at a constant speed slower than the infeed speed at rolls 13, 13 by rolls 20, 20 to form a yarn package 21.

Figure 2:
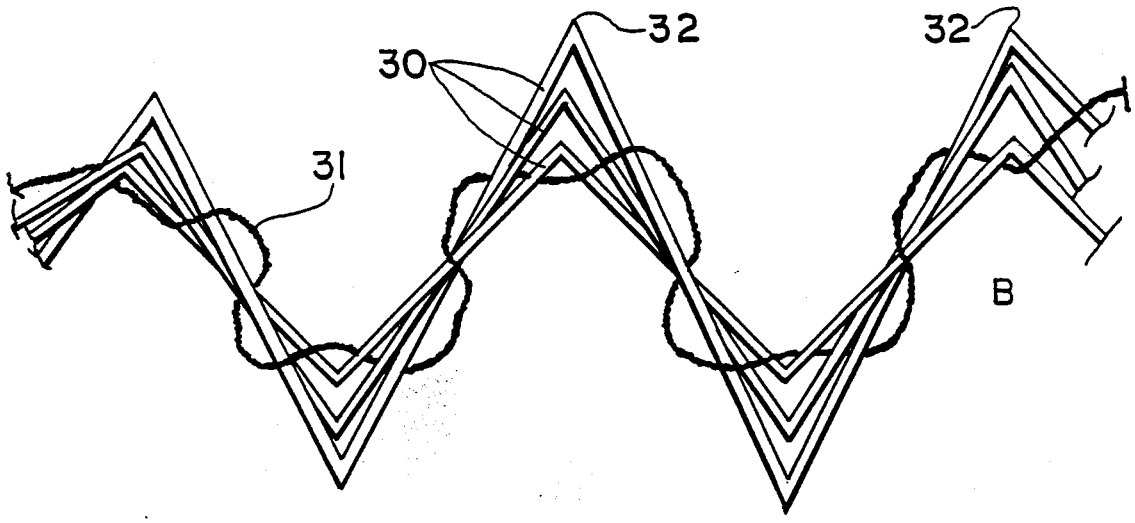
FIG. 2 is an idealized schematic view, greatly enlarged, showing typical features of a yarn product in accordance with this invention. For sake of simplicity only three monofilament yarns are shown in FIG. 2, each having a multiplicity of heat-set bends, it being appreciated that larger numbers such as 5–30 filaments are intended to be bundled together in accordance with this invention.

Turning to FIG. 2, the yarn product is shown in idealized form to illustrate an important concept of this invention. As shown it comprises a multiplicity of individual monofilaments 30, each of heavy denier and at least a majority of which have deniers in the range of about 50 to 1000 when the number of filaments per bundle is about 5–20. The number 31 designates a wrapper yarn helically wrapped around the bundle of monofilaments 30, and as shown the wrapper yarn 31 itself has a multiplicity of crimps, either previously formed or formed as a result of the crimping taking place in the stuffer crimper chamber 14. As appears in FIG. 2, the plurality of monofilaments 30 have a multiplicity of bundle-crimped and heat-set zigzag crimps 32 which repeat lengthwise along the lengths of the monofilaments and along the length of the bundle B. As shown in FIG. 2, at least a portion of the respective crimps of individual monofilaments 30 are essentially in phase with one another in the bundle as a result of the wrapped bundle crimping step. This produces a product having remarkable springlike properties, especially for the purposes heretofore discussed.

It will be appreciated that the environment in the stuffer box crimper tends to form yarn portions that are somewhat randomly crimped, in addition to the regular and uniform bundle-crimps as shown in idealized form in FIG. 2. For example, additional folds sometimes appear in the leg portions, and the leg portions are not always uniform in length. However, the bundle crimping effect produces at least portions of the product wherein the crimps, controlled by the wrapper yarn, have a regular repetition of spring-like legs, which is a very desirable feature.

The monofilaments 30 may be made of a wide variety of materials but are preferably thermoplastic monofilaments and still more preferably composed of polypropylene or monopolyester, for example. Although FIG. 2 shows only three monofilaments for ease of illustration and clarity of understanding, the preferred number of monofilaments contained in the bundle is at least 5–30 monofilaments, preferably 10 to 20.

The preferred relationship between denier per filament and number of filaments in the bundle, based upon actual tests using polypropylene and polyethylene terephthalate, has been found to be as follows:

| Number of Filaments | Denier per Filament (approximate) |
|---|---|
| 5–9 | 50–1000 |
| 10–13 | 100–1000 |
| 14–16 | 150–1000 |
| 17–20 | 200–1000 |
| 21–30 | 200–1000 |

When the denier per filament is substantially lower than the minimum numbers set forth on each line above, air entangling tends to become possible or actually to take place, allowing the filaments to be at least partially bundled by air entangling. The filaments according to the invention are too stiff to be air entangled and there is no substantial amount of air entangling according to this invention.

Preferably the wrapper yarn 31 is also thermoplastic and, as shown, is provided with a multiplicity of zigzag crimps extending along its length. Wide varieties of wrapper yarns may be used so long as they are strong enough and pliable enough to perform the bundle controlling function at least during and after the crimping operation.

Figure 3:
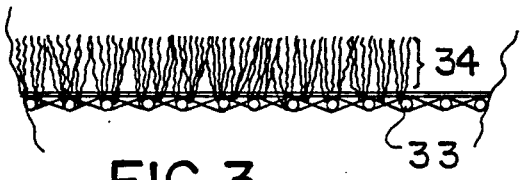
FIG. 3 is an enlarged view showing, in cross-section, a typical floor mat comprising a base and a multiplicity of tufts extending from the base, such tufts being made of a spring-like yarn of the kind shown in FIG. 2.

FIG. 3 shows a mat comprising a base 33 and a multiplicity of tufts 34 extending from the base 33. The tufts comprise stiff, pliable yarn products of the kind shown in FIG. 2, made by the process shown in FIG. 1.

It will accordingly be appreciated that, in accordance with the method of making the stiff, spring-like pliable yarn product, the bundle B is gathered together as shown in FIG. 1 and contains a plurality of heavy denier thermoplastic monofilaments having deniers of about 50 to 1000, and the wrapper yarn W is helically wrapped around the gathered monofilaments, wrapped under sufficient tension to form and maintain a wrapped bundle, which is continuously fed into the confined space contained within the stuffer crimper chamber 14, while the bundle is at an elevated temperature. This elevated temperature may be achieved in a variety of ways, including the use of preheater godet roll 10, or the heating of the actual chamber 14 itself, or its feed rolls, for example. In its heated condition, the wrapper yarn-controlled bundle of heavy denier monofilaments has a tendency to buckle and fold in a controlled manner upon itself as a unit, to form a multiplicity of zigzag crimps of the type schematically shown in FIG. 2, wherein at least a part of the crimps of individual filaments are essentially in phase with one another. The product P in FIG. 1 is continuously withdrawn from the confined space contained within the chamber 14, resulting in cooling of the crimped, wrapped yarn product P.

The denier of the wrapper yarn 3 of FIG. 2 is not critical but the wrapper yarn should be strong enough to hold the monofilaments together as a bundle both during and after the texturizing operation.

While FIG. 3 shows cut pile tufts they may be of various forms, such as loop pile tufts, for example. Other variations may be made, as will be apparent to those skilled in the art.

Although this invention has been described in connection with a particular apparatus and method, and with respect to particular materials and yarn configurations, it will be appreciated that many variations may be made, including the substitution of equivalent crimping and texturizing devices and methods for those specifically shown and described, the use of certain features independently of other features, and reversal of sequences of method steps, all without departing from the spirit and scope of the invention as defined in the appended claims.

I claim:

1. A stiff, pliable texturized yarn product comprising a bundle of heavy denier thermoplastic monofilaments, said filaments having a denier per filament of at least about 50 and being too stiff to be maintained as a bundle by air entangling for subsequent fabrication, and a wrapper yarn substantially continuously wrapped around said bundle, said plurality of the monofilaments in said wrapped bundle having a multiplicity of heat-set bends repeating lengthwise along the lengths of said monofilaments.

2. The yarn product defined in claim 1 wherein the respective bends of individual monofilaments are at least partially in phase with one another in said bundle.

3. The product defined in claim 1 wherein the monofilaments comprise polypropylene.

4. The product defined in claim 1 wherein the monofilaments have a filament number of about 5 to 30 per bundle and a denier per filament of about 50 to 1000.

5. The product defined in claim 1 wherein the bundle contains a number of monofilaments in relation to the denier per filament approximately according to the following table:

| Number of Filaments | Denier per Filament |
|---|---|
| 5–9 | 50–1000 |
| 10–13 | 100–1000 |
| 14–16 | 150–1000 |
| 17–20 | 200–1000 |

-continued

| Number of Filaments | Denier per Filament |
|---|---|
| 21–30 | 200–1000 |

6. The product defined in claim 1 wherein the wrapper yarn is also thermoplastic and is provided with a multiplicity of zigzag crimps extending along its length.

7. A tufted woven floor covering comprising a base and a multiplicity of tufts having spring-like quality extending from said base, said tufts comprising stiff, pliable texturized yarn products as defined in claim 1.

8. In a method of making a stiff, pliable yarn product, the steps which comprise:

(a) gathering together a plurality of havy denier thermoplastic monofilaments having a denier per filament of about 50 to about 1000, (b) continuously wrapping about 5 to 30 of said gathered monofilaments with a flexible wrapper yarn to form a wrapped bundle, (c) continuously feeding said wrapped bundle into a confined space while said bundle is at an elevated temperature causing said bundle repeatedly to buckle and fold upon itself as a unit to form a multiplicity of texturized bends, wherein the bends of individual filaments are at least partially in phase with one another, and (d) continuously withdrawing the product from said confined space and cooling the resulting texturized wrapped yarn product.

* * * * *